US010317148B2

(12) United States Patent
Hakamata et al.

(10) Patent No.: US 10,317,148 B2
(45) Date of Patent: Jun. 11, 2019

(54) HEAT EXCHANGER

(71) Applicant: DENSO CORPORATION, Kariya, Aichi-pref. (JP)

(72) Inventors: Osamu Hakamata, Kariya (JP); Tatsuo Ozaki, Kariya (JP); Shinta Mabuchi, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/039,063

(22) PCT Filed: Nov. 19, 2014

(86) PCT No.: PCT/JP2014/005793
§ 371 (c)(1),
(2) Date: May 25, 2016

(87) PCT Pub. No.: WO2015/079653
PCT Pub. Date: Jun. 4, 2015

(65) Prior Publication Data

US 2017/0038163 A1 Feb. 9, 2017

(30) Foreign Application Priority Data

Nov. 27, 2013 (JP) ..... 2013-244749
Sep. 3, 2014 (JP) ..... 2014-179461

(51) Int. Cl.
*F28F 9/04* (2006.01)
*F28F 9/02* (2006.01)
(Continued)

(52) U.S. Cl.
CPC ..... *F28F 9/0226* (2013.01); *F28D 1/05383* (2013.01); *F28F 9/182* (2013.01);
(Continued)

(58) Field of Classification Search
CPC .... F28F 9/0226; F28F 9/0224; F28F 2265/26; F28F 9/0219; F28F 9/04
(Continued)

(56) References Cited

U.S. PATENT DOCUMENTS 4,331,201 A 5/1982 Hesse
5,664,625 A 9/1997 Letrange et al.
(Continued)

FOREIGN PATENT DOCUMENTS

CN 1162107 A 10/1997
FR 2904101 A1 1/2008
(Continued)

*Primary Examiner* — Jason N Thompson
(74) *Attorney, Agent, or Firm* — Harness, Dickey & Pierce, P.L.C.

(57) ABSTRACT

The heat exchanger has tubes and a header tank that is located at an end of the tubes in a longitudinal direction and communicates with the tubes. The header tank has a core plate that connects to the tubes and a tank body that is fixed to the core plate. The core plate has a tube connection surface, a sealing surface, and an inclined surface that connects the tube connection surface and the sealing surface with each other. A distance between the tube connection surface and an end surface of the tubes in the longitudinal direction is different from a distance between the sealing surface and the end surface in the longitudinal direction by disposing the inclined surface to incline with respect to the longitudinal direction. The tubes connect to the tube connection surface and the inclined surface in a condition of being inserted to the tube connection surface and the inclined surface.

14 Claims, 12 Drawing Sheets

(51) Int. Cl.
*F28F 9/18* (2006.01)
*F28D 1/053* (2006.01)

(52) U.S. Cl.
CPC ..... *F28D 1/05366* (2013.01); *F28F 2225/08* (2013.01); *F28F 2275/122* (2013.01); *F28F 2280/04* (2013.01)

(58) Field of Classification Search
USPC ..... 165/173
See application file for complete search history.

(56) References Cited

U.S. PATENT DOCUMENTS 5,816,316 A * 10/1998 Hoffnung ..... F28F 9/0224 165/173
6,772,518 B2 * 8/2004 Demuth ..... B21D 28/28 165/173
8,181,694 B2 5/2012 Powers et al.
8,776,873 B2 * 7/2014 Mross ..... F28D 1/05391 165/173
9,046,311 B2 6/2015 Powers et al.
2002/0134529 A1 * 9/2002 Nozaki ..... F02B 29/0456 165/51
2005/0039900 A1 2/2005 Yu
2005/0133208 A1 6/2005 Powers et al.
2008/0000626 A1 * 1/2008 Sugito ..... F28D 1/05366 165/173
2008/0135220 A1 6/2008 Aksoy et al.
2009/0255657 A1 * 10/2009 Hakamata ..... B23P 15/26 165/178
2011/0017435 A1 1/2011 Lesueur et al.
2011/0168364 A1 * 7/2011 Okuyama ..... F28F 9/0226 165/148

FOREIGN PATENT DOCUMENTS

JP H04108186 U1 9/1992
JP 2005061826 A 3/2005
JP 2005308366 A 11/2005
JP 2006162194 A 6/2006
JP 2008032384 A 2/2008
JP 2008528930 A 7/2008
JP 2011511923 A 4/2011
KR 20120074846 A 7/2012
WO WO 2008151680 A1 * 12/2008 ..... F28D 1/05366
WO WO-2008151680 A1 12/2008
WO WO-2011061085 A1 5/2011
WO WO 2012159971 A1 * 11/2012 ..... B21D 53/02
WO WO-2013135541 A2 9/2013

* cited by examiner

HEAT EXCHANGER

CROSS REFERENCE TO RELATED APPLICATIONS

This application is a U.S. National Phase Application under 35 U.S.C. 371 of International Application No. PCT/JP2014/005793 filed on Nov. 19, 2014 and published in Japanese as WO 2015/079653 A1 on Jun. 4, 2015. This application is based on and claims the benefit of priority from Japanese Patent Application No. 2013-244749 filed on Nov. 27, 2013 and Japanese Patent Application No. 2014-179461 filed on Sep. 3, 2014. The entire disclosures of all of the above applications are incorporated herein by reference.

TECHNICAL FIELD

The present disclosure relates to a heat exchanger.

BACKGROUND ART

Conventionally, a header tank of a heat exchanger such as a radiator is configured by integrally coupling a core plate that is made of metal and connects with each of tubes and a tank body that is made of resin and defines a space in the header tank. A gasket (i.e., a sealing member) that is made of an elastic material such as rubber is disposed between the core plate and the tank body. The gasket seals between the core plate and the tank body by being compressed by the core plate and the tank body.

Specifically, the core plate has a tube connection surface to which the tubes are connected and a groove that is formed in an outer periphery of the tube connection surface. A tip portion of the tank body on a side adjacent to the core plate is inserted to the groove of the core plate. The tank body is fixed to the core plate by crimping in a condition where the gasket is disposed between the groove of the core plate and the tip portion of the tank body.

According to such a heat exchanger, the groove is provided in the core plate. Accordingly, a length of the core plate in a flow direction of external fluid (i.e., air) becomes longer for the groove. Thus, a length of the heat exchanger as a whole in an airflow direction may become longer. Hereafter, the airflow direction will be referred to as a dimension in a width direction.

On the other hand, a heat exchanger in which the groove of the core plate is omitted to decrease the dimension in the width direction is disclosed (for example, refer Patent Literature 1). Specifically, according to a heat exchanger described in Patent Literature 1, a gasket is directly arranged on the tube connection surface of the core plate that is connected in a condition where the tubes are inserted to the tube connection surface. An end portion of the tank body is located on the gasket. The tank body is fixed to the core plate by crimping in a condition where the gasket is disposed between the tube connection surface of the core plate and the tip portion of the tank body.

PRIOR ART LITERATURES

Patent Literature

Patent Literature 1: WO 2011/061085 A1

SUMMARY OF INVENTION

However, according to studies conducted by the inventors of the present disclosure, the gasket is directly arranged on the tube connection surface of the core plate in the heat exchanger described in Patent Literature 1. As a result, when the tank body is fixed to the core plate by crimping, the gasket may be displaced.

The present disclosure addresses the above issue, and it is an objective of the present disclosure to provide a heat exchanger in which a displacement of a sealing member can be suppressed, and a dimension of the heat exchanger in a width direction can be small.

A heat exchanger of a first aspect of the present disclosure has tubes and a header tank. The tubes are arranged side by side, and fluid flows in the tubes. The header tank is located at an end of the tubes in a longitudinal direction, extends in a direction in which the tubes are arranged, and communicates with the tubes. The header tank has a core plate to which the tubes are connected and a tank body that is fixed to the core plate. The tank body is fixed to the core plate by crimping. The core plate has a tube connection surface, a sealing surface, and an inclined surface. A sealing member that is elastically deformable is disposed to the sealing surface. The inclined surface connects the tube connection surface and the sealing surface with each other. A distance between the tube connection surface and an end surface of the tubes in the longitudinal direction is different from a distance between the sealing surface and the end surface in the longitudinal direction by disposing the inclined surface to incline with respect to the longitudinal direction. The tubes connect to the tube connection surface and the inclined surface in a condition of being inserted to the tube connection surface and at least a part of the inclined surface.

Alternatively, according to a heat exchanger of a second aspect of the present disclosure, a distance between the tube connection surface and an end surface of the tubes in the longitudinal direction may be shorter than a distance between the sealing surface and the end surface in the longitudinal direction.

A displacement of the sealing member can be suppressed because the distance between the tube connection surface and the end surface of the tubes in the longitudinal direction is different from the distance between the sealing surface and the end surface in the longitudinal direction.

Furthermore, a dimension of the tube connection surface in the width direction can be small by connecting the tubes with the tube connection surface and the inclined surface in a condition of being inserted to the tube connection surface and the inclined surface. Therefore, a dimension of the header tank in the width direction can be small. Thus, a dimension of the heat exchanger in the width direction can be small while being suppressing the displacement of the sealing member.

DESCRIPTION OF EMBODIMENTS

Embodiments of the present disclosure will be described hereafter referring to drawings. In the embodiments, a part that corresponds to or equivalents to a matter described in a preceding embodiment may be assigned with the same reference number.

First Embodiment

A first embodiment of the present disclosure will be described hereafter referring to drawings. In the present embodiment, an example in which a heat exchanger of the present embodiment is used for a radiator for a vehicle that performs a heat exchange between an engine cooling water and air to cool the engine cooling water will be described.

Figure 1:
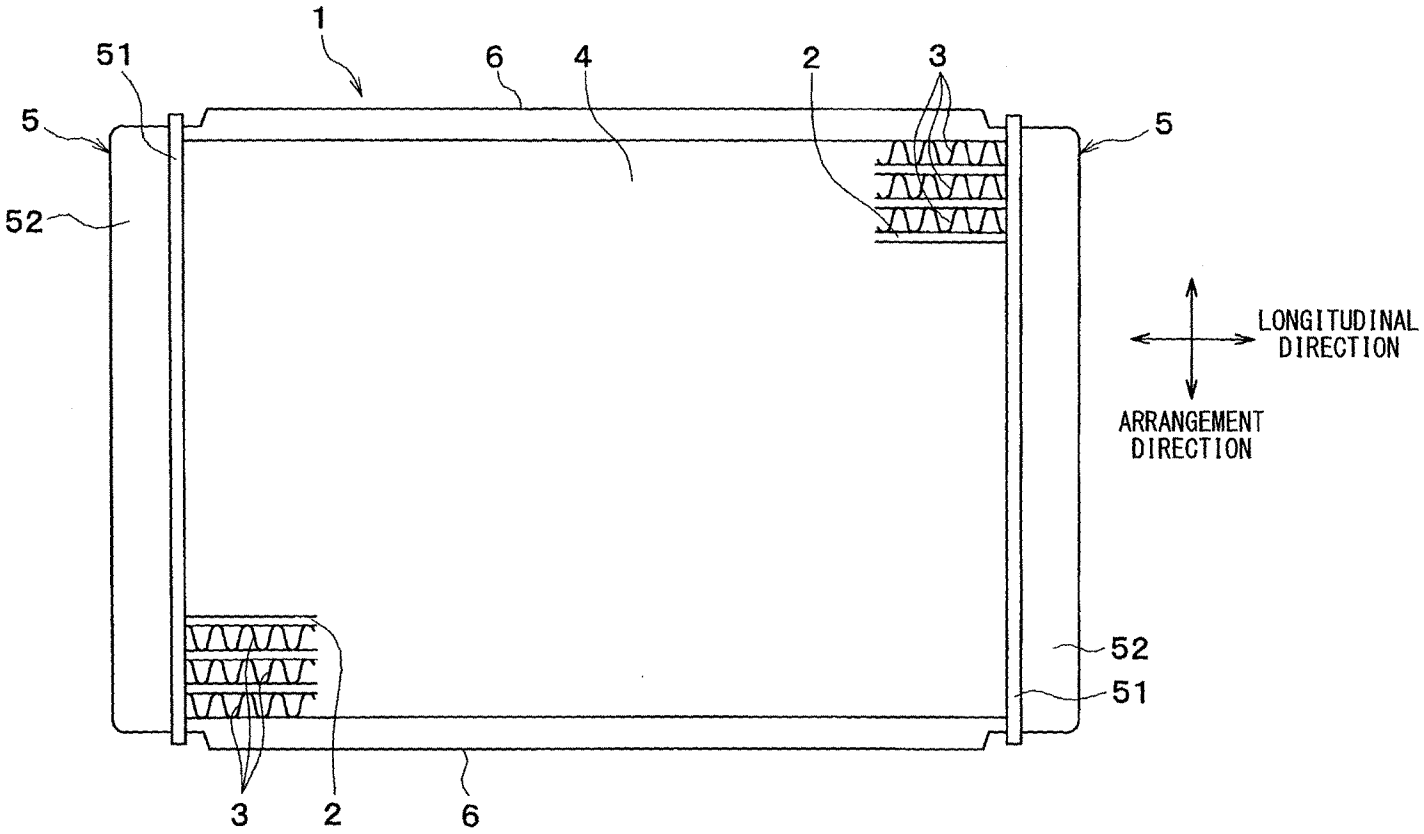
FIG. 1 is a schematic front view illustrating a radiator according to a first embodiment.

As shown in FIG. 1, a radiator 1 of the present embodiment has a core part 4 that has tubes 2 and fins 3 and a pair of header tanks 5 that are arranged on both end portions of the core part 4 respectively.

The tubes 2 are a pipe in which fluid flows. In the present embodiment, the fluid means the engine cooling water. The tubes 2 are formed to have a flat shape such that a longitudinal direction of the tubes 2 coincides with a flow direction of the fluid. The tubes 2 are arranged side by side in a direction (i.e., an arrangement direction) perpendicular to the longitudinal direction to be parallel with each other, such that the longitudinal direction coincides with a horizontal direction. In the following description, the direction in which the tubes 2 are arranged side by side will be referred to as the arrangement direction.

Each of the fins 3 is formed to have a corrugated shape and connected to a flat surface of the tubes 2 on both sides of the tube 2. The fins 3 promote a heat exchange between air and the engine cooling water flowing in the tubes 2 by increasing a heat transfer area that is in contact with the air.

The header tank 5 is located on each side of the tubes 2 in the longitudinal direction and extends in the longitudinal direction to communicate with the tubes 2. According to the present embodiment, one header tank 5 is arranged on each end portion of the tubes 2 in the longitudinal direction. The header tank 5 has a core plate 51 and a tank body 52. The core plate 51 is connected with the tubes 2 in a condition where the tubes 2 are inserted to the core plate 51. The tank body 52 configures a tank space together with the core plate 51.

A side plate 6 that reinforces the core part 4 is disposed in each end portion of the core part 4 in the arrangement direction. The side plate 6 extends in the longitudinal direction, and both end portions of the side plate 6 are connected to the pair of header tanks 5 respectively.

Hereafter, a direction perpendicular to both the longitudinal direction of the tubes 2 and the arrangement direction will be referred to as a width direction. The width direction is parallel with an airflow direction.

A configuration of the header tank 5 will be described in detail referring to FIGS. 2 to 6. An illustration of a gasket 53 described after is omitted in FIG. 2.

Figure 2:
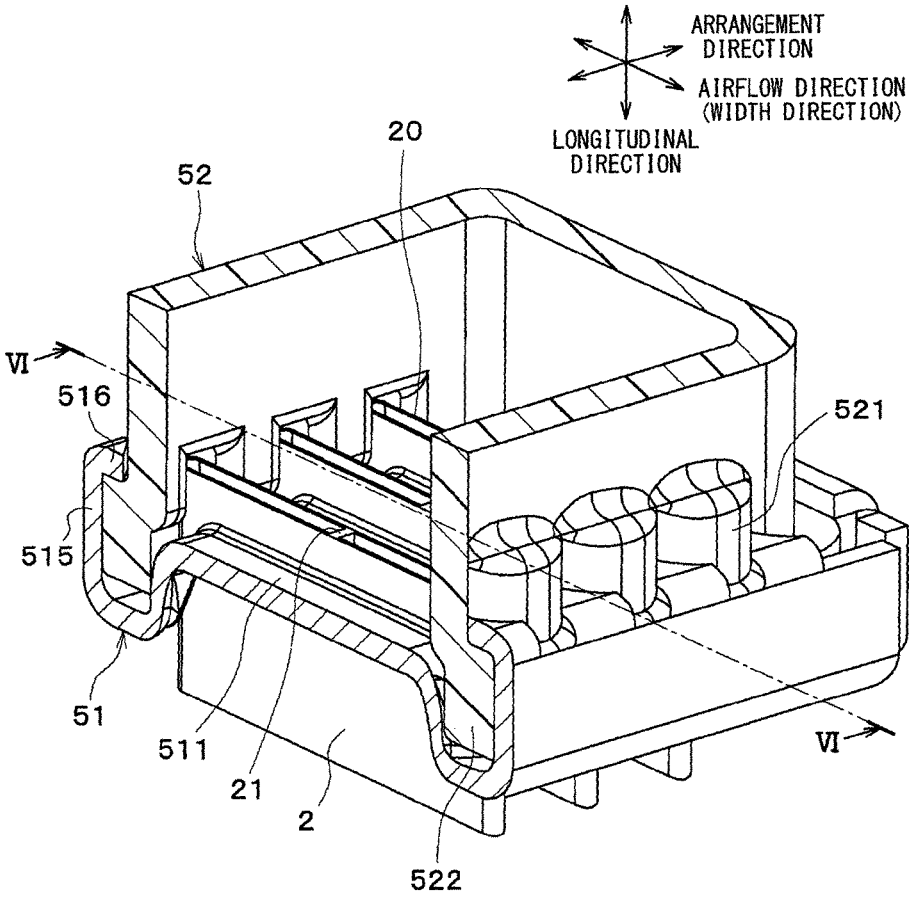
FIG. 2 is an exploded perspective view illustrating a part around a header tank of the radiator illustrated in FIG. 1.
Figure 6:
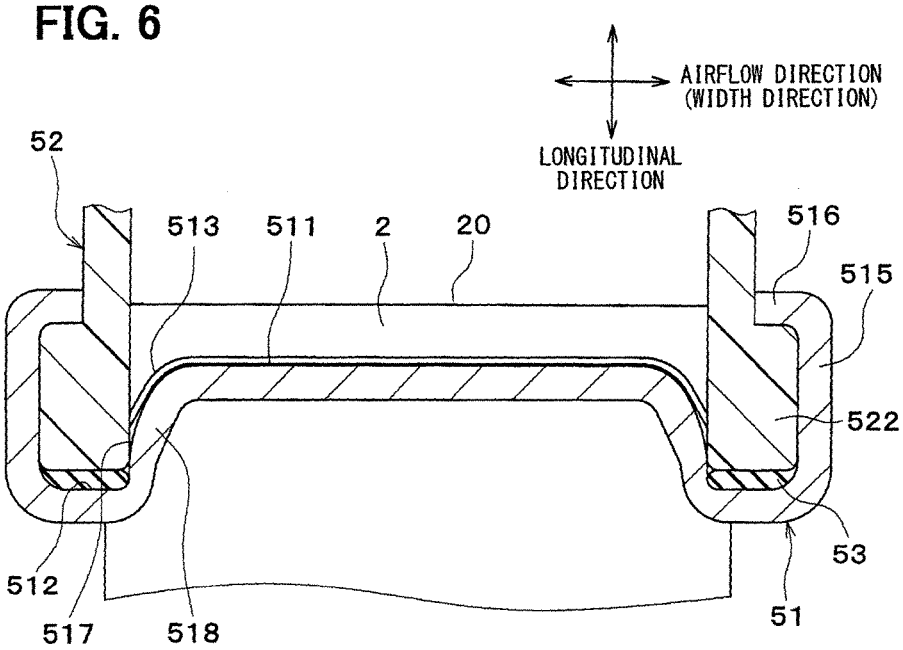
FIG. 6 is a sectional view taken along a line VI-VI shown in FIG. 2.

As shown in FIG. 2, the header tank 5 has the core plate 51, the tank body 52, and the gasket 53 (refer FIG. 6). The tubes 2 and the side plate 6 are connected to the core plate 51 in a condition of being inserted to the core plate 51. The tank body 52 provides a space in the header tank 5 together with the core plate 51. The gasket 53 is a sealing member that seals between the core plate 51 and the tank body 52. According to the present embodiment, the core plate 51 is made of an aluminum alloy, and the tank body 52 is made of resin such as a glass reinforcement polyamide that is reinforced by glass fibers.

The tank body 52 is fixed to the core plate 51 by crimping in a condition where the gasket 53 is disposed between the core plate 51 and the tank body 52. Specifically, the tank body 52 is crimped such that crimping click portions 516 of the core plate 51 described after are plastically deformed to push against the tank body 52. The gasket 53 of the present embodiment is made of rubber that is elastically deformable. More specifically, the gasket 53 of the present embodiment is made of ethylene-propylene-diene rubber (EPDM).

Figure 3:
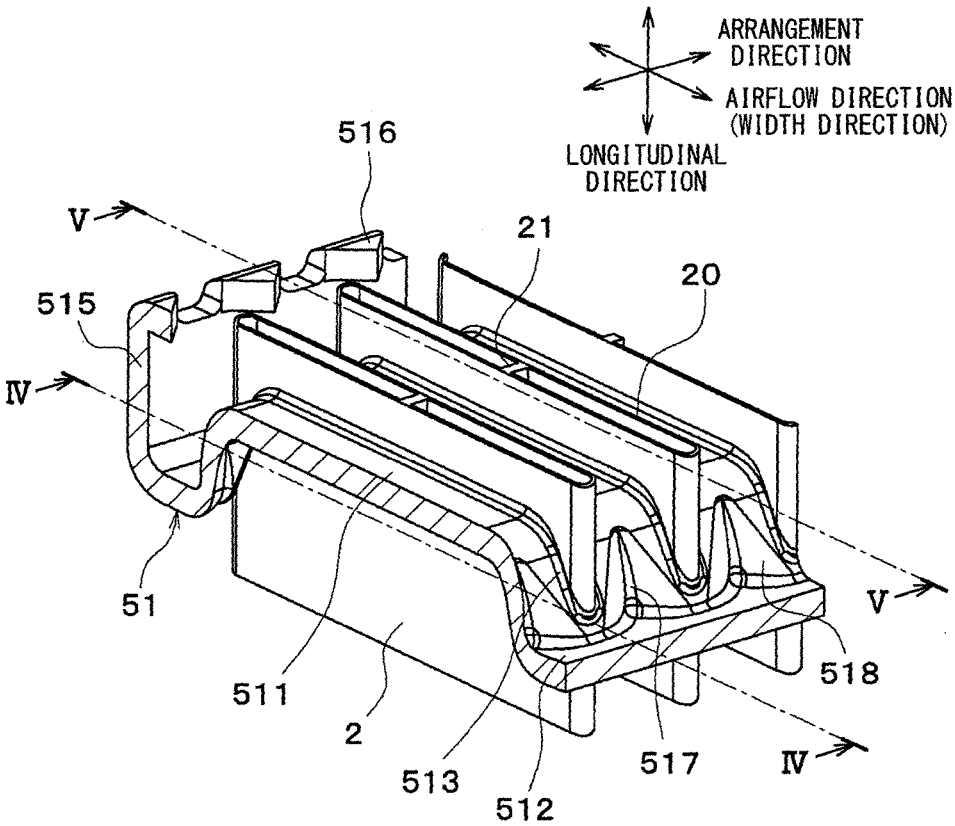
FIG. 3 is an exploded perspective view illustrating a part around a core plate of the radiator illustrated in FIG. 1.
Figure 4:
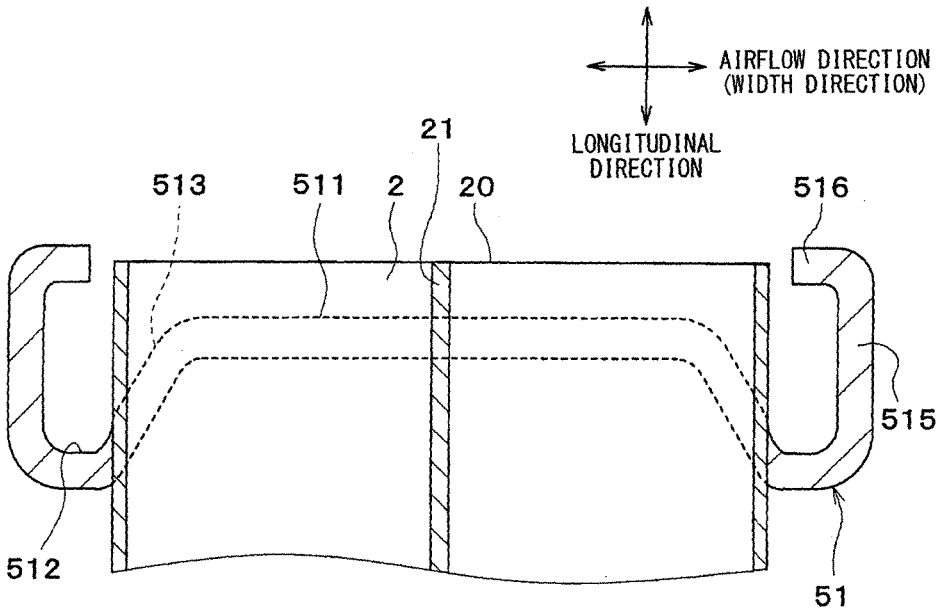
FIG. 4 is a sectional view taken along a line IV-IV shown in FIG. 3.
Figure 5:
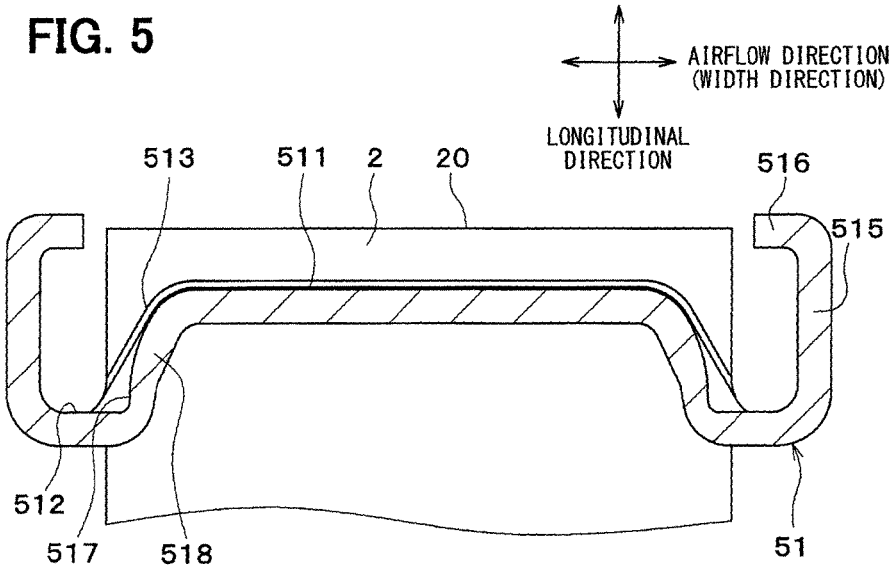
FIG. 5 is a sectional view taken along a line V-V shown in FIG. 3.

As shown in FIGS. 3, 4, and 5, the core plate 51 has a tube connection surface 511, a sealing surface 512 on which the gasket 53 is arranged, and an inclined surface 513 that connects the tube connection surface 511 and the sealing surface 512 with each other. According to the present embodiment, the tube connection surface 511 and the sealing surface 512 are parallel with each other. Specifically, the tube connection surface 511 and the sealing surface 512 are arranged to be perpendicular to the longitudinal direction.

According to the present embodiment, the inclined surface 513 inclines with respect to each of the tube connection surface 511 and the sealing surface 512. In other words, the inclined surface 513 inclines with respect to the longitudinal direction. Specifically, each of an angle between the sealing surface 512 and the inclined surface 513 and an angle between the tube connection surface 511 and the inclined surface 513 is an obtuse angle.

As shown in FIG. 6, the tubes 2 has an end surface (i.e., a tube end surface) 20 in the longitudinal direction. A distance between the tube connection surface 511 and the tube end surface 20 in the longitudinal direction is different from a distance between the sealing surface 512 and the tube end surface 20 in the longitudinal direction by disposing the inclined surface 513 to incline with respect to the longitudinal direction. According to the present embodiment, the distance between the tube connection surface 511 and the tube end surface 20 in the longitudinal direction is shorter than the distance between the sealing surface 512 and the tube end surface 20 in the longitudinal direction. That is, the sealing surface 512 is located on an inner side of the tube connection surface 511 (i.e., a side adjacent to the core part 4) in the longitudinal direction of the tubes 2.

The tube connection surface 511 and the inclined surface 513 are provided with tube insert holes (not shown) that are arranged one after another in the arrangement direction. The tubes 2 are inserted to the tube insert holes and brazed thereto respectively. The tubes 2 connect to the tube connection surface 511 and the inclined surface 513 in a condition of being inserted to the tube connection surface 511 and the inclined surface 513. The tube 2 may be inserted to the tube connection surface 511 and at least a part of the inclined surface 513.

The tube connection surface 511 and the inclined surface 513 are provided further with side-plate insert holes (not shown) to which the side plates 6 are inserted and brazed respectively. One side plate 6 is provided on each of one end side and the other end side of both the tube connection surface 511 and the inclined surface 513 in the arrangement direction. The side plates 6 connect to the tube connection surface 511 and the inclined surface 513 in a condition of being inserted to the tube connection surface 511 and the inclined surface 513 through the side-plate insert holes respectively.

The core plate 51 has an outer wall 515 that is bent toward a side opposite to the core part 4 from the sealing surface 512 at generally right angle and extends in the arrangement direction or the airflow direction.

A rib 518 that has a surface parallel with the longitudinal direction is disposed between adjacent two of the tubes 2 in the inclined surface 513 of the core plate 51. The surface that is parallel with the longitudinal direction and has the rib 518 will be referred to as a parallel surface 517. According to the present embodiment, the parallel surface 517 is perpendicular to the airflow direction. An angle between the parallel surface 517 and the sealing surface 512 is generally a right angle. The rib 518 is formed to protrude outward from the header tank 5.

As shown in FIG. 2, a length of the tank body 52 in the airflow direction is shorter than a length of the tubes 2 in the airflow direction. The tank body 52 has bulge portions 521 that bulges outward from the tank body 52 at a position facing the tube 2. Accordingly, an inner surface of the tank body 52 and an outer surface of the tube 2 are prevented from being in contact with each other.

The tank body 52 has a flange portion 522, a thickness at which is larger than a thickness at other positions of the tank body 52, at a location facing a position between adjacent two of the tubes 2, in other words, at a location where the bulge portions 521 are not provided. The flange portion 522 is arranged on the sealing surface 512 of the core plate 51 through the gasket 53.

The core plate 51 has the crimping click portions 516. The crimping click portions 516 protrude toward the tank body 52 from the outer wall 515. Each of the crimping click portions 516 is located at a location corresponding to a position between adjacent two of the tubes 2 in the core plate 51, in other words, at a location corresponding to a position of the flange portion 522 of the tank body 52. As shown in FIG. 6, the tank body 52 is fixed to the core plate 51 by crimping the crimping click portions 516 against the flange portion 522 of the tank body 52.

As shown in FIGS. 2 and 3, an inner column 21 that is provided to connect adjacent two flat surfaces of the tube 2 with each other and improves a pressure resistance of the tubes 2 is provided inside of the tube 2. According to the present embodiment, the inner column 21 is located in a center portion of the inside of the tube 2 in the airflow direction. A fluid passage defined in the tube 2 is divided into two by the inner column 21.

As described above, according to the present embodiment, the core plate 51 has the tube connection surface 511 and the sealing surface 512. The distance between the tube connection surface 511 and the tube end surface 20 in the longitudinal direction is different from the distance between the sealing surface 512 and the tube end surface 20 in the longitudinal direction. That is, in the core plate 51 of the present embodiment, a surface (i.e., the tube connection surface 511) to which the tubes 2 are inserted and connected and a surface (i.e., the sealing surface 512) on which the gasket 53 is arranged are not located on the same flat surface. When the core plate 51 is crimped against the tank body 52, the header tank 5 is in contact with the inclined surface 513 of the core plate 51 and retained. As a result, an interference with the tubes 2 can be suppressed.

Furthermore, a displacement of the gasket 53 can be suppressed since the gasket 53 is in contact with the inclined surface 513 when the core plate 51 is crimped against the tank body 52. Specifically, the displacement of the gasket 53 can be suppressed more accurately by providing the sealing surface 512 between the inclined surface 513 and the outer wall 515.

In addition, according to the present embodiment, the tubes 2 are connected to both the tube connection surface 511 and the inclined surface 513 in the condition of being inserted to both the tube connection surface 511 and the inclined surface 513. Therefore, a dimension of the tube connection surface 511 in the width direction becomes small, and a dimension of the header tank 5 in the width direction can be small. As a result, a dimension of the radiator 1 in the width direction can be small.

Here, according to the heat exchanger of Patent Literature 1, the flange portion 522 of the tank body 52 is located on the tube connection surface 511 of the core plate 51. Therefore, when the tank body 52 is arranged on the core plate 51 in a manufacturing process of the header tank 5, the flange portion 522 may be in contact with the tubes 2, and the tubes 2 may be damaged. Further, the tank body 52 may deform toward an inside of the header tank 5 when the core plate 51 is crimped against the tank body 52, and the tubes 2 may be damaged.

On the other hand, according to the present embodiment, the core plate 51 has the rib 518 having the parallel surface 517 parallel with the longitudinal direction at a location corresponding to the position between adjacent two of the tubes 2 in the inclined surface 513. Accordingly, when the tank body 52 is assembled to the core plate 51, the flange portion 522 of the tank body 52 is in contact with the parallel surface 517 of the rib 518 in the core plate 51. Thus, the flange portion 522 can be prevented from being in contact with the tubes 2.

According to the present embodiment, the tank body 52 and the core plate 51 are fixed to each other by crimping in a condition where the flange portion 522 of the tank body 52 is in contact with the parallel surface 517 of the rib 518 provided with the core plate 51. Therefore, when the core plate 51 is crimped against the tank body 52, the tank body 52 can be prevented from deforming toward the inside of the header tank 5.

Thus, according to the radiator 1 of the present embodiment, the tubes 2 can be certainly prevented from being damaged.

Further, the flange portion 522 of the tank body 52 is in contact with the parallel surface 517 by providing the rib 518 that has the parallel surface 517 parallel with the longitudinal direction at a location corresponding to the position between adjacent two of the tubes 2 in the inclined surface 513 of the core plate 51. Accordingly, the tank body 52 can be retained certainly when the flange portion 522 is arranged on the core plate 51 and when the core plate 51 is crimped against the tank body 52.

Second Embodiment

A second embodiment of the present disclosure will be described hereafter referring to drawings. According to the second embodiment, a configuration around tube insert holes of the core plate 51 is different as compared to the above-described first embodiment.

Figure 7:
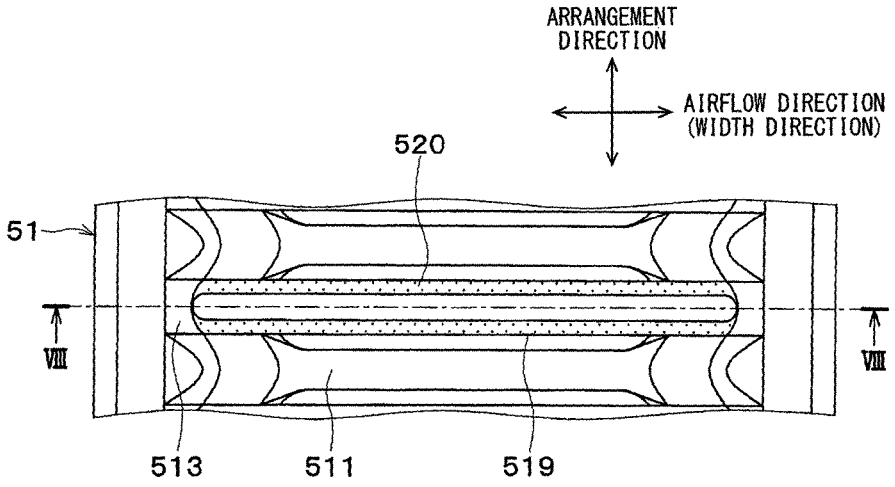
FIG. 7 is an enlarged plane view illustrating a part of a core plate when viewed in a longitudinal direction, according to a second embodiment.

As shown in FIG. 7, the tube connection surface 511 and the inclined surface 513 of the core plate 51 have tube insert holes 519 that are arranged one after another in the arrangement direction, and the tubes 2 are inserted and brazed to the tube insert holes 519 respectively. The tube insert holes 519 may be provided with the tube connection surface 511 and at least a part of the inclined surface 513. The tube insert holes 519 are not necessary to be provided in an entirety of the inclined surface 513.

Figure 8:
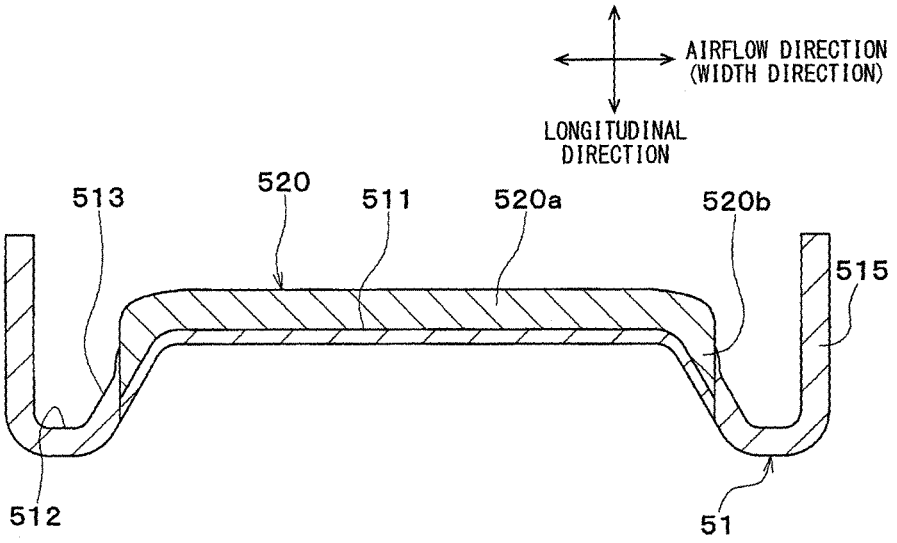
FIG. 8 is a sectional view taken along a line VIII-VIII shown in FIG. 7.
Figure 11:
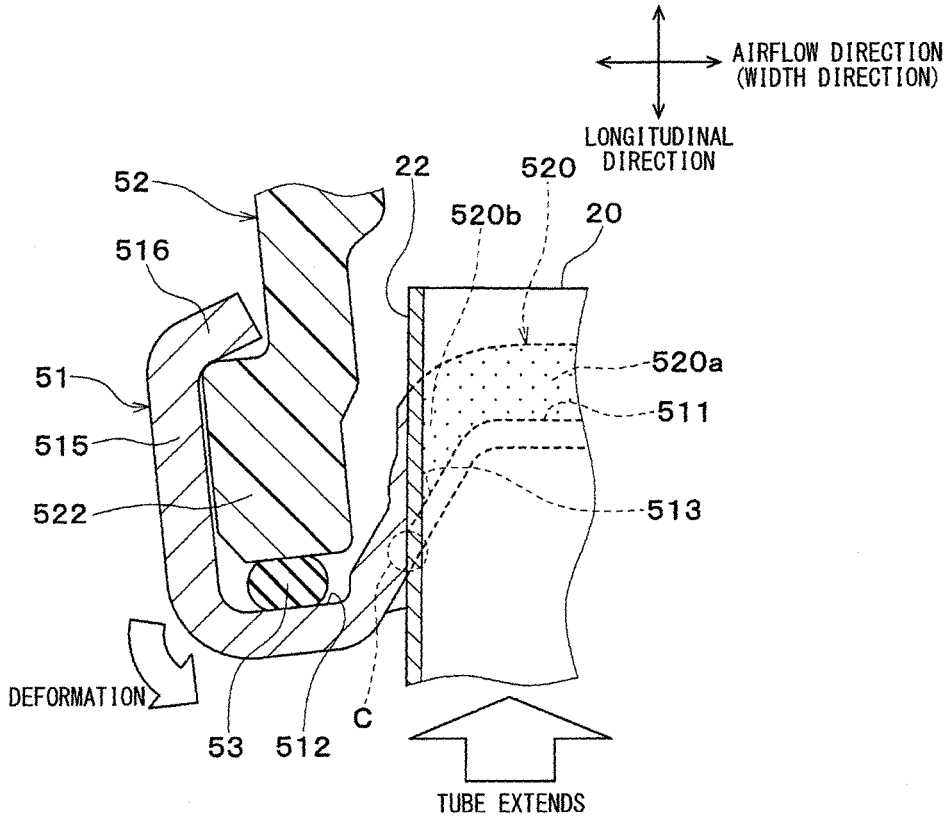
FIG. 11 is an explanatory diagram illustrating a part around a connection part between the core plate and a tube, according to the second embodiment.

As shown in FIG. 7 and FIG. 8, each of the tube insert holes 519 has a periphery that is provided with a burring part 520 protruding toward the tube end surface 20 in the longitudinal direction (refer FIG. 11). The burring part 520 is connected to both the tube connection surface 511 and the inclined surface 513 of the core plate 51. The burring part 520 is formed by burring the periphery of the tube insert holes 519.

Hereafter, a portion of the burring part 520 that is connected to the tube connection surface 511, in other words, that faces the tube connection surface 511 will be referred to as a first burring portion (i.e., a first portion) 520*a*. A portion of the burring part 520 that is connected to the inclined surface 513, in other words, that faces the inclined surface 513 will be referred to as a second burring portion (i.e., a second portion) 520*b*. The first burring portion 520*a* and the second burring portion 520*b* are formed integrally.

Figure 9:
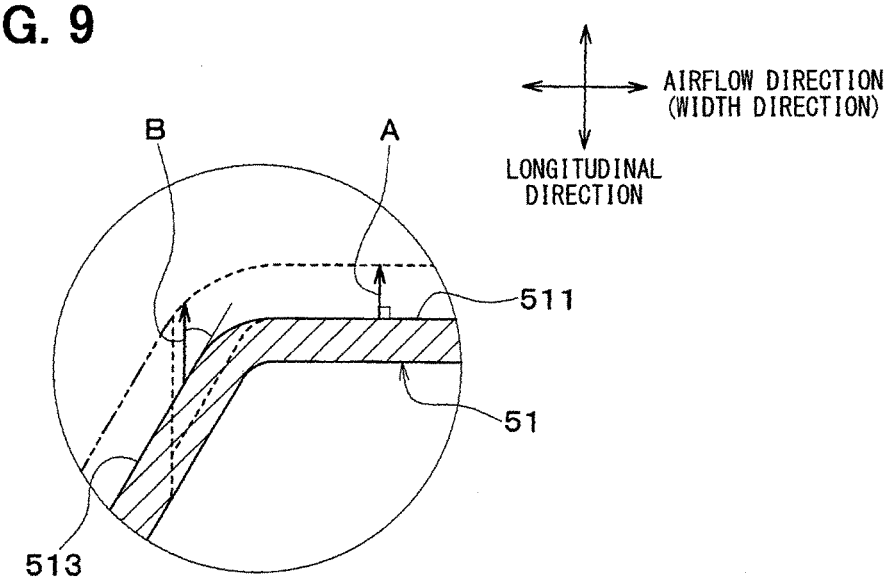
FIG. 9 is an enlarged sectional view illustrating a part of the core plate of the second embodiment in a previous condition of forming a burring part.
Figure 10:
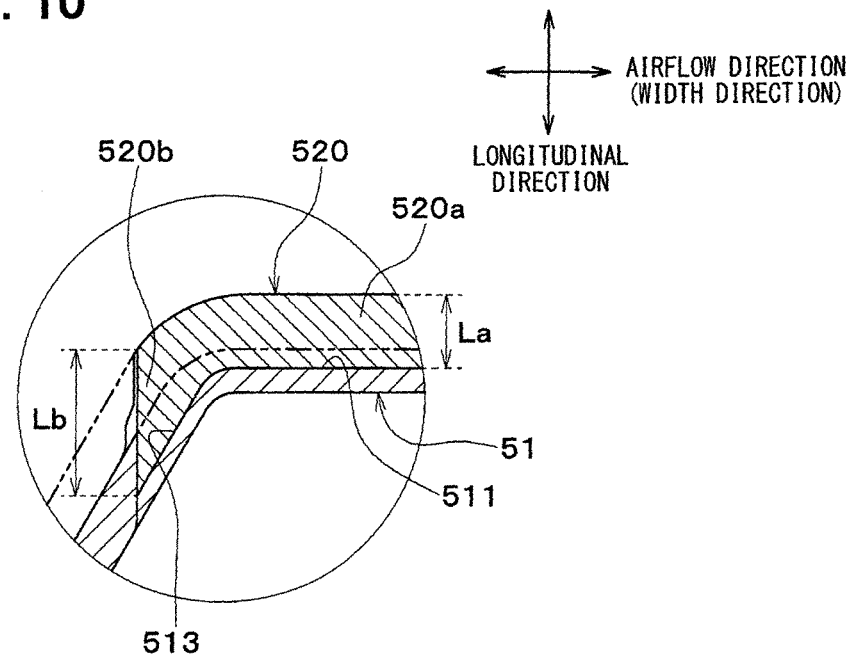
FIG. 10 is an enlarged sectional view illustrating the part of the core plate of the second embodiment in a condition after the burring part is formed.

As shown in FIG. 9, in the tube connection surface 511, a burr forming direction of the first burring portion 520*a* (refer an arrow A in FIG. 9) is perpendicular to the tube connection surface 511. In the inclined surface 513, a burr forming direction of the second burring portion 520*b* (refer an arrow B in FIG. 9) makes an acute angle with the inclined surface 513. Accordingly, a length Lb of the second burring portion 520*b* in the longitudinal direction is larger than a length La of the first burring portion 520*a* in the longitudinal direction.

As described above, according to the present embodiment, the tube insert holes 519 has the periphery that is provided with the burring part 520 protruding toward the tube end surface 20 in the longitudinal direction. Therefore, strength in a connection part between the core plate 51 and the tubes 2 can be improved, and a thermal distortion resistance (i.e., resistance against thermal distortion) can be improved.

As shown in FIG. 11, in the connection part between the core plate 51 and the tubes 2, a maximum thermal distortion occurs in a connection part C between the inclined surface 513 and an outer end 22 of the tube 2 in the width direction (i.e., the airflow direction). Hereafter, the connection part C will be referred to as a maximum thermal distortion occurring part C.

According to the present embodiment, the length Lb, in the longitudinal direction, of the second burring portion 520*b* connected to the inclined surface 513 is larger than the length La, in the longitudinal direction, of the first burring portion 520*a* connected to the tube connection surface 511. Accordingly, a length of the second burring portion 520*b* in the longitudinal direction corresponding to the maximum thermal distortion occurring part C becomes longer, and the thermal distortion resistance in the maximum thermal distortion occurring part C can be improved.

Third Embodiment

A third embodiment of the present disclosure will be described hereafter referring to drawings. According to the third embodiment, configurations of the core plate 51 and the tank body 52 are different as compared to the above-described first embodiment.

Figure 12:
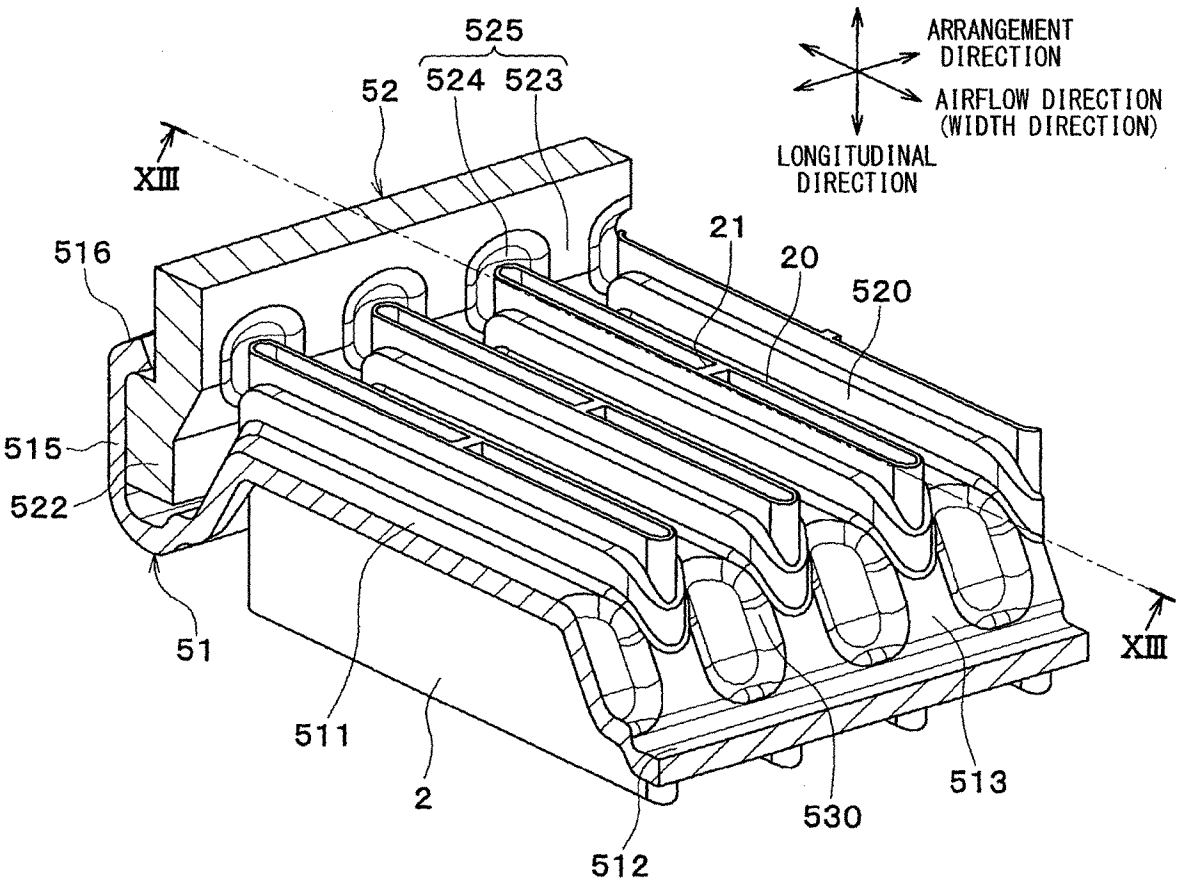
FIG. 12 is an exploded perspective view illustrating a part around a core plate of a radiator according to a third embodiment.
Figure 13:
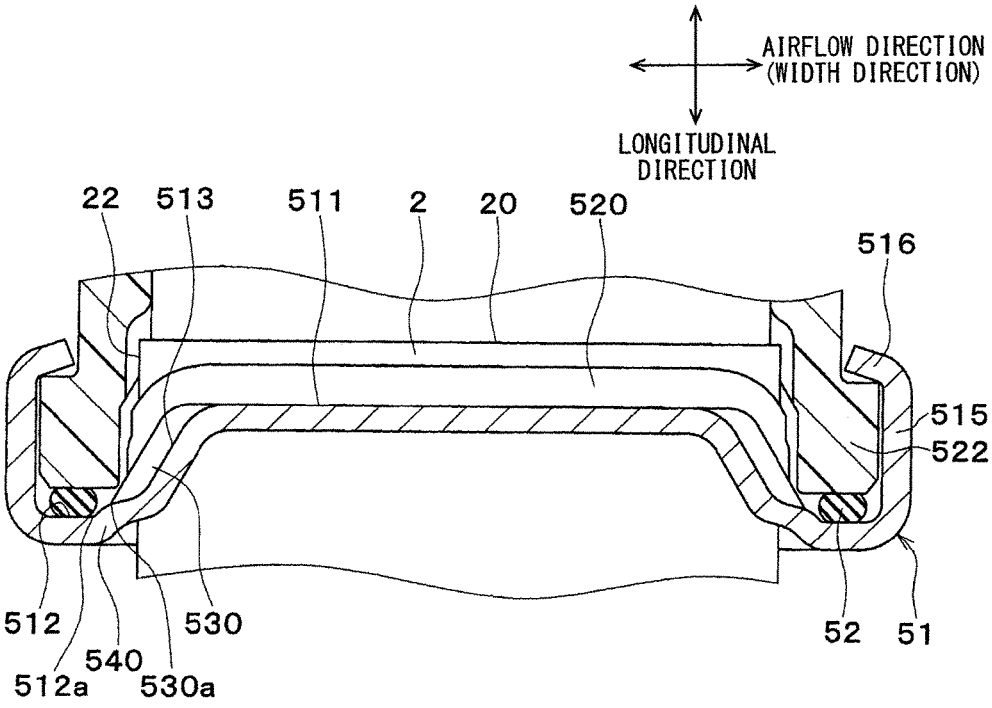
FIG. 13 is a sectional view taken along a line XIII-XIII shown in FIG. 12.

As shown in FIG. 12 and FIG. 13, the inclined surface 513 of the core plate 51 has a rib 530 protruding in the longitudinal direction between adjacent two of the tubes 2. The rib 530 has an outer end 530*a* in the width direction (i.e., the airflow direction), and the outer end 530*a* is located on an outer side of the outer end 22 of the tube 2 in the width direction. That is, the rib 530 is provided to extend across the outer end 22 of the tube 2 when viewed in the arrangement direction. In other words, the rib 530 is provided to extend from an inner side through an outer side of the outer end 22 of the tube 2 in the width direction.

As shown in FIG. 13, the sealing surface 512 of the core plate 51 has an inner end 512*a* in the width direction, and the inner end 512*a* is located on an outer side of the outer end 22 of the tube 2 in the width direction. According to the present embodiment, the inner end 512*a* of the sealing surface 512 in the width direction is located on an outer side of the outer end 530*a* of the rib 530 in the width direction. In other words, when the width direction is defined as a direction perpendicular to both the longitudinal direction of the tubes 2 and the arrangement direction that is perpendicular to the longitudinal direction, the rib 530 has the outer end 530*a* in the width direction, and the tubes 2 has the outer end 22 in the width direction. The outer end 530*a* of the rib 530 is located on the outer side of the outer end 22 of the tube in the width direction.

Therefore, when the tubes 2 are viewed in the arrangement direction, the outer end 22 of the tube 2, the outer end 530*a* of the rib 530, and the inner end 512*a* of the sealing surface 512 are arranged in this order from an inner side to an outer side in the width direction.

Further, according to the present embodiment, the outer end 530*a* of the rib 530 is located on an outer side of the inner end 512*a* of the sealing surface 512 in the longitudinal direction (i.e., on an outer side of the core part 4). Therefore, in the core plate 51, a stepped portion 540 is provided between the inclined surface 513 and the sealing surface 512. The outer end 530*a* of the rib 530 is located on an inner side of the stepped portion 540 in the width direction.

Figure 14:
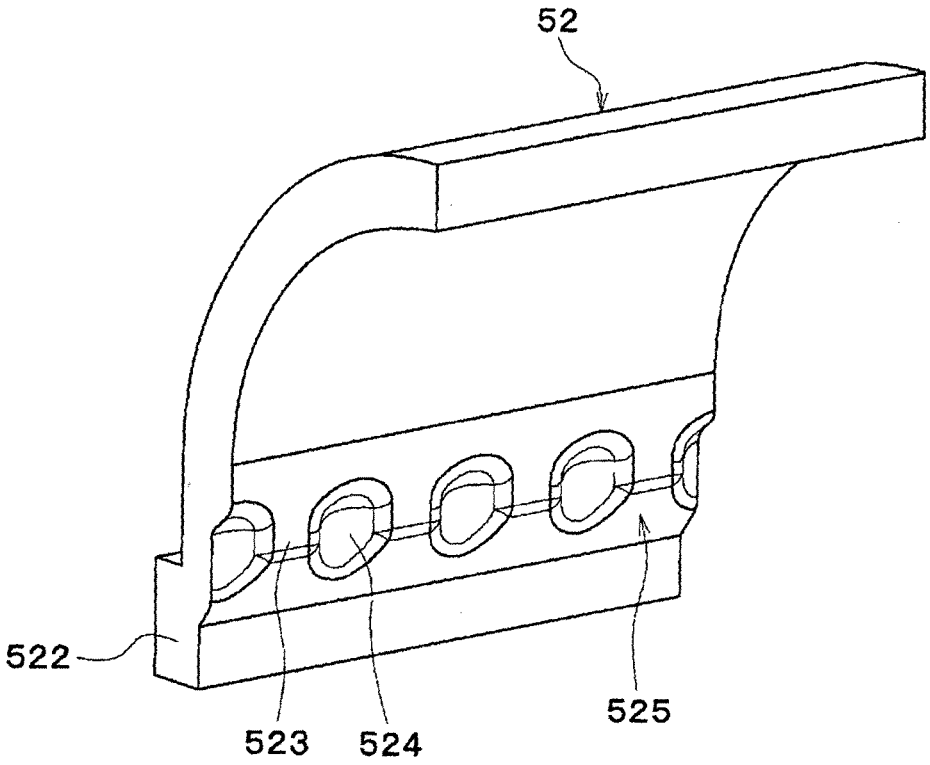
FIG. 14 is an enlarged perspective view illustrating a part of a tank body according to the third embodiment.

As shown in FIG. 12 and FIG. 14, the tank body 52 has an inner surface provided with a corrugated portion 525, and the corrugated portion 525 has protruding portions 523 and recessed portions 524 that are arranged alternately. The inner surface of the tank body 52 includes a surface that is generally perpendicular to the width direction, and the corrugated portion 525 is provided in the surface.

Each of the protruding portions 523 of the corrugated portion 525 is located between adjacent two of the tubes 2. A distance between one of the protruding portions 523 and another one of the protruding portions 523 that faces the one of the protruding portions 523 in the width direction is shorter than a length of the tube 2 in the width direction. That is, an inner width of the tank body 52 defined by the protruding portions 523 is shorter than the length of the tube 2 in the width direction. The inner width of the tank body 52 is a length of the inside of the tank body 52 in the width direction.

Each of the recessed portions 524 of the corrugated portion 525 is located on an outer side of the tubes 2 in the width direction. The outer end 22 of the tubes 2 in the width direction is housed inside of the recessed portion 524. That is, the outer end 22 of the tube 2 in the width direction is located inside of the recessed portion 524. The recessed portions 524 have an inner surface having a curved shape (i.e., an ark shape in cross section).

As described above, according to the present embodiment, the outer end 530*a* of the rib 530 is located on the outer side of the outer end 22 of the tube 2 in the width direction. Accordingly, strength at the connection part C between the inclined surface 513 of the core plate 51 and the outer end 22 of the tubes 2 in the width direction (i.e., the airflow direction) can be improved. Therefore, in the connection part between the core plate 51 and the tubes 2, a thermal distortion resistance in the maximum thermal distortion occurring part C can be improved certainly.

Figure 15:
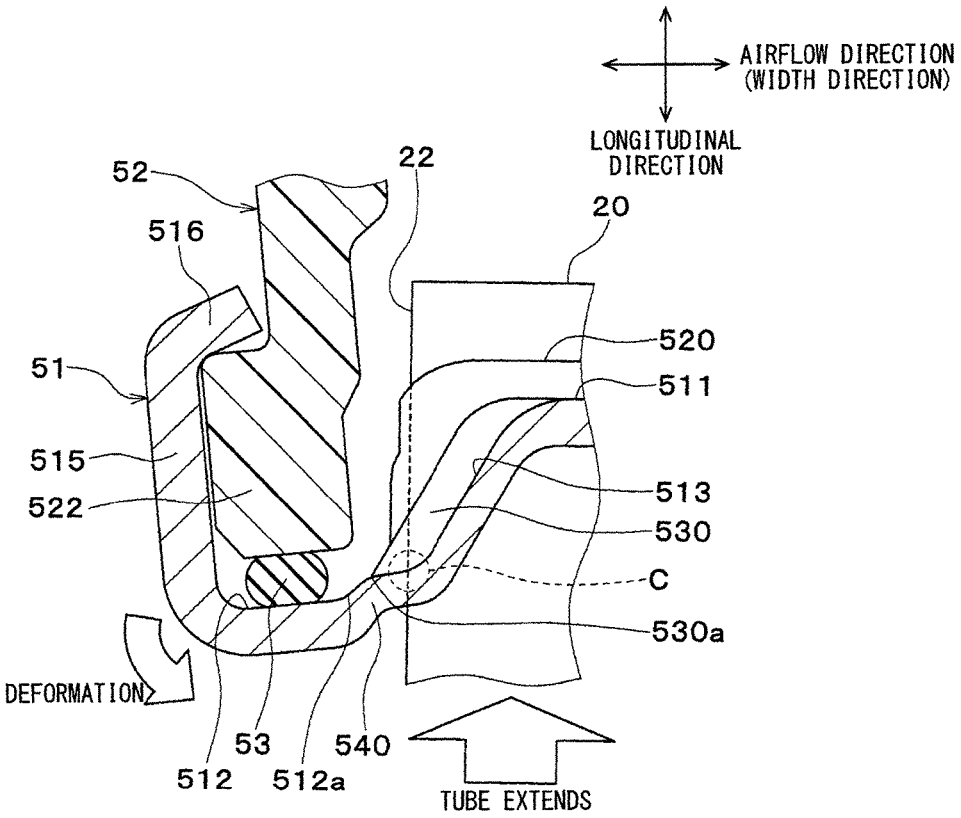
FIG. 15 is an explanatory diagram illustrating a part around a connection part between the core plate and a tube, according to the third embodiment.

According to the present embodiment, the inner end 512*a* of the sealing surface 512 is located on the outer side of the outer end 530*a* of the rib 530 in the width direction. Accordingly, as shown in FIG. 15, the core plate 51 can be bent easily at the inner end 512*a* of the sealing surface 512 when the thermal distortion occurs. Therefore, thermal distortion can be absorbed by deforming the core plate 51.

Furthermore, according to the present embodiment, the stepped portion 540 is formed between the inclined surface 513 and the sealing surface 512 in the core plate 51, and the outer end 530*a* of the rib 530 is located on the inner side of the stepped portion 540 in the width direction. Accordingly, since the core plate 51 has different strengths by the stepped portion 540, the core plate 51 can be more easily bent at the stepped portion 540 when the thermal distortion occurs.

When the inner end 512*a* of the sealing surface 512 is located on the inner side of the outer end 530*a* of the rib 530 in the width direction, strength of the inner end 512*a* of the sealing surface 512 is improved by the rib 530. Therefore, when the thermal distortion occurs, the core plate 51 is hardly bent at the inner end 512*a* of the sealing surface 512.

Further, according to the present embodiment, the inner surface of the recessed portion 524 has a curved shape. Accordingly, stress can be prevented from concentrating in the recessed portions 524, and pressure resistance of the header tank 5 can be improved. In addition, by providing the recessed portions 524 in the inner surface of the tank body 52, the bulge portions 521 corresponding to the recessed portions 524 are not necessary to be provided in the outer surface of the tank body 52. Therefore, the outer surface of the tank body 52 can be formed in a flat shape, and designing flexibility for the crimping click portions 516 of the core plate 51 can be improved.

Other Modifications

It should be understood that the present disclosure is not limited to the above-described embodiments and intended to cover various modification within a scope of the present disclosure as described hereafter. Technical features disclosed in the above-described embodiments may be combined as required in a feasible range.

(1) In the above-described embodiments, an example that an angle between the sealing surface 512 and the inclined surface 513 is a obtuse angle is described. However, the angle between the sealing surface 512 and the inclined surface 513 may be a right angle. That is, the inclined surface 513 may be perpendicular to the sealing surface 512.

(2) In the above-described embodiments, an example that the tube connection surface 511 is entirely parallel with the sealing surface 512 is described. However, a part of the tube connection surface 511, for example, a center portion of the tube connection surface 511 in the width direction of the header tank 5 may be parallel with the sealing surface 512.

(3) In the above-described embodiments, an example that the heat exchanger of the present disclosure is used for the radiator 1 is described. However, the heat exchanger of the present disclosure may be able to be used for another heat exchanger such as an evaporator or a refrigerant radiator (i.e., a refrigerant condenser).

(4) In the above-described embodiments, the gasket 53 is configured separately from the core plate 51 and the tank body 52 is described. However, a configuration of the gasket 53 is not limited to the example. For example, the gasket 53 is coupled with one of the core plate 51 and the tank body 52 by gluing or is formed integrally with one of the core plate 51 and the tank body 52.

(5) In the above-described embodiments, an example that the crimping click portions 516 of the core plate 51 are bent and crimped against the flange portion 522 of the tank body 52 is described. However, a fixing configuration of the core plate 51 by crimping is not limited to the example. For example, a slit may be formed in a part of the outer wall 515 of the core plate 51. In this case, the slit is deformed plastically in the airflow direction to engage with a protruding portion and a recessed portion formed in the flange portion 522 of the tank body 52, such that the core plate 51 is fixed by being crimped against the tank body 52.

What is claimed is:

1. A heat exchanger comprising:

a plurality of tubes that are arranged side by side and in which a fluid flows; and a header tank that is located at an end of the plurality of tubes in a longitudinal direction, extends in a direction in which the plurality of tubes are arranged, and communicates with the plurality of tubes, wherein the header tank has:

a core plate to which the plurality of tubes are connected; and a tank body that is fixed to the core plate by crimping, the core plate has:

a tube connection surface;

a sealing surface to which a sealing member that is elastically deformable is disposed;

an inclined surface extends between the tube connection surface and the sealing surface;

a corner portion is formed between and connects the tube connection surface and the inclined surface;

a stepped portion is formed between and connects the sealing surface and the inclined surface, the stepped portion defining a protrusion protruding upward toward the header tank; and a rib at a position corresponding to a location in the inclined surface between two of the plurality of tubes adjacent to each other, the rib extending from the corner portion to the stepped portion;

a distance between the tube connection surface and an end surface of the plurality of tubes in the longitudinal direction is different from a distance between the sealing surface and the end surface in the longitudinal direction by disposing the inclined surface to incline with respect to the longitudinal direction, the plurality of tubes connect to the tube connection surface and the inclined surface by being inserted into the tube connection surface and at least a part of the inclined surface, when a width direction is defined as a direction perpendicular to both the longitudinal direction of the plurality of tubes and the direction in which the plurality of tubes are arranged, the rib has an outer end in the width direction, and the plurality of tubes respectively has an outer end in the width direction, the outer end of the rib is located on an outer side of the outer end of the plurality of tubes in the width direction, and the outer end of the rib is located on an inner side of the protrusion defined by the stepped portion in the width direction.

2. The heat exchanger according to claim 1, wherein the inclined surface inclines with respect to the sealing surface.

3. The heat exchanger according to claim 1, wherein at least a part of the tube connection surface is arranged parallel with the sealing surface.

4. The heat exchanger according to claim 1, wherein the tube connection surface and at least a part of the inclined surface are provided with a plurality of tube insert holes to which the plurality of tubes are inserted respectively, and the plurality of tube insert holes have a periphery that is provided with a burring part protruding toward the end surface in the longitudinal direction.

5. The heat exchanger according to claim 4, wherein the burring part has a second portion that connects to the inclined surface and a first portion that connects to the tube connection surface, and a length of the second portion in the longitudinal direction is longer than a length of the first portion in the longitudinal direction.

6. The heat exchanger according to claim 1, wherein the sealing surface has an inner end in the width direction that is located on an outer side of the outer end of the plurality of tubes in the width direction.

7. The heat exchanger according to claim 1, wherein the sealing surface has an inner end in the width direction that is located on an outer side of the outer end of the rib in the width direction.

8. The heat exchanger according to claim 1, wherein the tank body has an inner surface provided with a corrugated portion that has a plurality of protruding portions and a plurality of recessed portions being arranged alternately and an outer surface opposing the inner surface in the width direction, the outer surface having a portion that is flat uniformly, the plurality of protruding portions and the plurality of tubes are, arranged alternately, a distance between one of the plurality of protruding portions and another one of the plurality of protruding portions that is adjacent to the one of the plurality of protruding portions is shorter than a length of each of the plurality of tubes in the width direction.

9. The heat exchanger according to claim 8, wherein the plurality of recessed portions are located on an outer side of the plurality of tubes in the width direction, and the outer end of the plurality of tubes in the width direction is housed inside of one of the plurality of recessed portions.

10. The heat exchanger according to claim 8, wherein each of the plurality of recessed portions has an inner surface that is a curved surface.

11. The heat exchanger according to claim 1, wherein the rib is triangular shaped having edge portions that are non-parallel to each other in the width direction.

12. The heat exchanger according to claim 1, wherein the rib is wedge shaped having edge portions that are non-parallel to each other in the width direction.

13. The heat exchanger according to claim 1, wherein the rib is oval shaped.

14. A heat exchanger comprising:

a plurality of tubes that are arranged side by side and in which a fluid flows; and a header tank that is located at an end of the plurality of tubes in a longitudinal direction, extends in a direction in which the plurality of tubes are arranged, and communicates with the plurality of tubes, wherein the header tank has:

a core plate to which the plurality of tubes are connected;

a tank body that is fixed to the core plate by crimping; and a sealing member that is elastically deformable and seals between the core plate and the tank body, the core plate has:

a tube connection surface;

a sealing surface to which a sealing member that is elastically deformable is disposed;

an inclined surface extends between the tube connection surface and the sealing surface;

a corner portion is formed between and connects the tube connection surface and the inclined surface;

a stepped portion is formed between and connects the sealing surface and the inclined surface, the stepped portion defining a protrusion protruding upward toward the header tank; and a rib at a position corresponding to a location in the inclined surface between two of the plurality of tubes adjacent to each other, the rib extending from the corner portion to the stepped portion;

a distance between the tube connection surface and an end surface of the plurality of tubes in the longitudinal direction is shorter than a distance between the sealing surface and the end surface in the longitudinal direction by disposing the inclined surface to incline with respect to the longitudinal direction, the plurality of tubes connect to the tube connection surface and the inclined surface by being inserted into the tube connection surface and at least a part of the inclined surface, an angle between the sealing surface and the inclined surface and an angle between the tube connection surface and the inclined surface are obtuse angles, when a width direction is defined as a direction perpendicular to both the longitudinal direction of the plurality of tubes and the direction in which the plurality of tubes are arranged, the rib has an outer end in the width direction, and the plurality of tubes respectively has an outer end in the width direction, the outer end of the rib is located on an outer side of the outer end of the plurality of tubes in the width direction, and the outer end of the rib is located on an inner side of the protrusion defined by the stepped portion in the width direction.

* * * * *